US007188684B2

(12) United States Patent
Nolan

(10) Patent No.: US 7,188,684 B2
(45) Date of Patent: Mar. 13, 2007

(54) LOCKING PIN ASSEMBLY FOR LOCKING DOG HOUSING

(76) Inventor: Philip D. Nolan, 230 E. 8th St., Hermann, MO (US) 65041-1302

( * ) Notice: Subject to any disclaimer, the term of this patent is extended or adjusted under 35 U.S.C. 154(b) by 153 days.

(21) Appl. No.: 11/003,049

(22) Filed: Dec. 3, 2004

(65) Prior Publication Data

US 2005/0126823 A1 Jun. 16, 2005

Related U.S. Application Data

(63) Continuation-in-part of application No. 10/892,972, filed on Jul. 16, 2004.

(60) Provisional application No. 60/488,601, filed on Jul. 18, 2003.

(51) Int. Cl.
*E21B 7/00* (2006.01)

(52) U.S. Cl. ..... 175/57; 403/378; 403/379.4

(58) Field of Classification Search ..... 175/57, 175/320; 403/378, 379.4
See application file for complete search history.

(56) References Cited

U.S. PATENT DOCUMENTS

| | | | | |
|---|---|---|---|---|
| 3,148,510 | A | 9/1964 | Sullivan | |
| 3,377,077 | A | 4/1968 | Hollander et al. | |
| 4,580,795 | A * | 4/1986 | Burtelson et al. | 279/76 |
| 6,050,740 | A * | 4/2000 | Dziedzic | 403/305 |

* cited by examiner

*Primary Examiner*—William Neuder
(74) *Attorney, Agent, or Firm*—Lewis, Rice & Fingersh, L.C.

(57) ABSTRACT

A locking pin mechanism for a locking dog which provides for a support sleeve including steps with indentations for supporting a grasping member, and pins whose slanted face intersects the plan of the drive wrench bore in the locking dog when the drive wrench is being installed.

19 Claims, 14 Drawing Sheets

LOCKING PIN ASSEMBLY FOR LOCKING DOG HOUSING

CROSS REFERENCE TO RELATED APPLICATION(S)

This application is a Continuation-in-Part of and claims priority to U.S. patent application Ser. No. 10/892,972 filed Jul. 16, 2004 and currently pending which in turn claims priority to U.S. Provisional Application Ser. No. 60/488,601 filed Jul. 18, 2003. The entire disclosure of both documents is herein incorporated by reference.

BACKGROUND OF THE INVENTION (1) Field of the Invention

The present invention pertains to an improved locking pin mechanism for use with a locking dog of the type commonly used to install earth anchors.

(2) Background of the Invention

Utility poles and other tall narrow structures are generally secured by both being placed deep into the earth that supports them and then anchoring them through the use of extending guy wires. The guy wires provide for support to prevent the structure from levering itself from its hole in the earth. The guy wires will generally extend from an upper portion of the pole or structure and will be connected to a device which will hold their opposing end to the earth at a distance from the base of the pole or structure. The device is generally referred to as an "anchor" and the anchor and guy wire arrangement prevents movement of the upper portion of the structure which could act to lever the structure through the ground tipping it over.

A myriad of anchor assemblies are available for use in different types of soils and substances and for different types of applications. One particularly common type of anchor used in the support of utility poles and other pole-like or tower structures is the screw type anchor (10) such as that shown in FIG. 1 and in U.S. Pat. No. 3,148,510 the entire disclosure of which is herein incorporated by reference. The screw type anchor (10) incorporates at least one screw flange (11) generally arranged toward the lower end (13) of the anchor (10) and a guy rod (15) which extends upwards from the screw flange (11) and is screwed or otherwise attached thereto. The guy rod (15) will generally terminate at its upper end (14) in a connector (17). The connector (17) will often be an externally threaded shaft (19) with a shoulder (21). While anchors (10) are particularly useful for the installation of guy wires, they are also used for the direct installation of tall structures (particularly those which are narrow and lack other foundations) such as street lights, transformers, bumper posts, and signs.

Anchors of this type are regularly installed in conjunction with the erection of a utility pole. An auger truck carries and controls the auger for drilling the pole's hole and includes a derrick structure for transferring rotary motion from a motor on board the auger truck to whatever object is attached to the derrick. The attachment will generally be at the terminal end of the derrick and will generally be a Kelly bar. The Kelly bar may be comprised of multiple segments connected together. When an auger is in use on the derrick, generally one of the segments of Kelly bar will extend through the central shaft of the auger and the auger will be attached toward the derrick and toward the top of the Kelly bar. If additional length is needed for the auger from the derrick (for instance in deep installations or when the truck is positioned on a hill or other inclined area), the auger may be positioned so that it is attached at the terminal end of the Kelly bar, instead of having the Kelly bar extend through the shaft of the auger, to provide for additional length to the auger from the derrick.

To install an earth anchor, generally the first step is to remove the auger from the derrick. Once the auger has been removed, a combination of devices for attaching the Kelly bar to the anchor (10) would be used. One such set of devices of the prior art is shown in FIG. 2. The design and operation of such devices is discussed at length in U.S. Pat. No. 3,377,077, the entire disclosure of which is herein incorporated by reference, but a general overview will be given here. The device comprises a connector (50) for connecting the Kelly bar to the locking dog (200) which in turn connects to a drive wrench (60). The locking dog (200) includes a sleeve (207) attached to a bolt flange (205). The sleeve (207) includes a non-circular, generally polygonal bore (209) thereinto. The non-circular cross-section of the bore (209) is utilized to prevent the drive wrench (60), when placed into the bore (209) in a socketing type of arrangement, from rotating relative to the bore (209). By convention, the bore (209) is usually square in cross-section.

The drive wrench (60) is generally fixed in position through a combination of cross-sectional shape and the inclusion of a pin locking mechanism in the locking dog (200). The drive wrench (60) includes two holes (61) through its outer surface and located towards its upper end (63). The locking dog (100) includes a pair of laterally extending sleeves (211) and (213), each of which includes a spring biased pin (221) and (223) located within each lateral sleeve (211) and (213), and normally biased inwardly so that one end of each pin extends into the bore (209). Rings (231) and (233) or other grasping aids may be provided upon pins (221) and (223) to facilitate a worker in pulling them outwardly, against the biasing. There may also be support mechanisms provided to hold the pins (221) and (223) in an outward position in the form of a stepped arrangement.

Each of the two pins (221) and (223) extends into the bore (209) of the locking dog (200) a predetermined distance at a first position to which it is naturally biased. Further, each of the pins (221) and (223) may be retracted and held in two different positions by pulling on the ring (231) or (233) and rotating the pin (221) or (223) to engage steps on the ends of the sleeves (211) and (213). In a second position, the pin (221) or (223) is partially retracted from the bore (209), and in a third position the pin (221) or (223) is fully retracted from the bore (209) as seen in FIG. 3. Each pin (221) and (223) will generally also include a slanted face (225) which extends from the innermost end of the pin (221) or (223) to a point along the pin's (221) or (223) length prior to the other end. When in the first position, this point along the pin's (221) or (223) length is within the bore (209) providing for a small ring (291) of the pin (221) or (223) to interact with the drive wrench (60).

To mount the anchor (10) to the derrick in preparation for installation, the drive wrench (60) is first placed into the bore (209) of the locking dog (200) with the pins (221) and (223) at their third (most retracted or outermost) position (FIG. 3C). While holding the drive wrench (60) in place in the bore (209), a worker will reach to the upper end (63) of the drive wrench (60) and rotate the pins (221) and (223) which releases them to their first position (FIG. 3A) which allows them to pass into the bore (209) and through the holes (61) in the drive wrench (60). With the drive wrench (60) so secured to the locking dog (200), the guy rod (15) is then threaded into the lower end (65) of the drive wrench (60). As the guy rod (15) is threaded through the drive wrench (60), the upper end (14) of the guy rod (15) will contact the slanted faces (225) of the pins (221) and (223) forcing them to move from the first position toward their second (FIG. 3B) (or even third) position although they will generally retract linearly instead of being rotated. The shoulder (21) will do the same when it contacts the slanted faces (225). It should be apparent that so long as the guy rod (15) fits inside the drive wrench (60), this movement will not allow the locking dog (200) to release the drive wrench (60) as the pins (221) and (223) will always be at least partially within the holes (61) in the drive wrench (60). Once the shoulder (21) passes over the pins (221) and (223), the pins (221) and (223) will be biased back under the shoulder (21) allowing the anchor (10) to be supported by the pins (221) and (223) and therefore attached to the locking dog (200).

At the time this attachment occurs, drive wrench (60) will have preferably mated with a device of similar shape to the drive wrench (60) above the screw flange (11) on the anchor (10). This mating will generally result in one of the two pieces socketing into the other. As the drive wrench (60) and this device preferably also have non-circular cross-sections, this socketing connection prevents the anchor (10) from rotating relative to the drive wrench (60) allowing the rotational motion imparted on the drive wrench (60) by the rotation of the locking dog (200) to be transferred to the anchor (10).

The anchor is then installed by activating the rotary movement of the auger truck's motor and boring the anchor into the ground using a screwing or drilling type action. Once the screw flange (11) is at the desired depth, the rotary motion provided by the auger truck will be stopped. The pins (221) and (223) will then be retracted and secured in their second position (FIG. 3B) which will free the guy rod (15) but not the drive wrench (60) and the auger truck will lift the derrick pulling the drive wrench (60) free of the guy rod (15). Once free, the guy rod (15) will generally be capped with an eyelet to cover the externally threaded shaft (19), and the anchor (10) is ready to be used. To lay another anchor (10), the pins (221) and (223) are returned to their first position (FIG. 3A) and the next anchor's (10) guy rod (15) is threaded through the drive wrench (60) as discussed above and the process is repeated.

While this process for laying anchors (10) has been used for many years, there are significant steps which are both cumbersome and dangerous in its performance. In particular, seating the drive wrench (60) in the locking dog (200) bore (209) is unnecessarily cumbersome as the worker has to reach up and manually release the pins (221) and (223) from their third position (FIG. 3C) to their first (FIG. 3A) while holding the drive wrench (60) in place. As the drive wrench (60) is generally about 4 feet or more in length, this can be very difficult. Further, the stepped locking mechanism for the pins (221) and (223) to support them in their second (FIG. 3B) and third (FIG. 3C) positions can allow for the grasping rings (231) and (233) to slip unexpectedly when trying to install or remove the guy rod (15) or the drive wrench (60).

SUMMARY OF THE INVENTION

Described herein are embodiments of locking pin mechanisms for a locking dog which provide for improved support of a grasping ring when the pin is in a retracted position and provide for an improved design of a locking pin which simplifies the drive wrench installation.

In an embodiment, there is described herein a locking dog comprising: a main body including a polygonal shaped bore, the bore having a bore stop at its terminal end and having a plurality of inner surfaces; a locking pin mechanism, the locking pin mechanism including: a locking pin, the locking pin having a central axis and including a slanted face toward one end of the central axis and having a grasping member toward the opposing end of the central axis; a support sleeve including a retaining step; and a biasing member for biasing the slanted face of the pin into the bore when the locking pin is positioned within the support sleeve; wherein, when the biasing member is in a first position where the grasping member is not interacting with the retaining step, the plane defined by at least one of the inner surfaces of the bore intersects with the slanted face.

In an embodiment of the locking dog, the pin can be retracted from the bore and the grasping member can be rotated to a second position such that the grasping member is in contact with the retaining step; the grasping member's contact with the retaining step preventing the biasing member from restoring the pin to the first position.

In an embodiment of the locking dog, the support sleeve includes a second retaining step and the pin can be retracted from the bore and the grasping member can be rotated to a third position such that the grasping member is in contact with the second retaining step; the grasping member's contact with the second retaining step preventing the biasing member from restoring the pin to the first position.

In an embodiment of the locking dog, one or both of the retaining step and the second retaining step includes an indentation, the indentation being designed to resist movement of the grasping member from the retaining step.

In an embodiment of the locking dog, the slanted face comprises two portions, each of the sections being arranged at a different angle relative to the central axis of the locking pin. The angles may comprise about 40 degrees and about 45 degrees.

In an embodiment of the locking dog, the slanted face preferably forms an angle of between 0 and 90 degrees, non-inclusive, with the central axis, more preferably the angle is between 40 and 50 degrees.

In another embodiment, there is described herein a locking dog comprising: a main body including a polygonal shaped bore, the bore having a bore stop at its terminal end; a locking pin mechanism, the locking pin mechanism including: a biasing member; and a locking pin, biased by the biasing member to a position whereby at least a portion of the locking pin extends into the bore, the locking pin including: a central axis; a grasping mechanism arranged towards one end of the central axis; and means to allow a drive wrench placed in the bore to move the locking pin against the biasing means to a position substantially clear of the bore.

In a still further embodiment, there is described a system for installing earth anchors, the system comprising: a derrick, having an adapter for attachment to a locking dog; a drive wrench; a locking dog, the locking dog including: a connector for attaching the locking dog to the adapter; a main body connected to the connector, the main body including a polygonal shaped bore, the bore having a bore stop at its terminal end and having a plurality of inner surfaces; a locking pin mechanism, the locking pin mechanism including: a locking pin, the locking pin having a central axis and including a slanted face toward one end of the central axis; a support sleeve; and a biasing member for biasing the slanted face of the pin into the bore when the locking pin is positioned within the support sleeve; wherein while the biasing member is biasing the pin into the bore, the drive wrench can be placed in the polygonal shaped bore and moved toward the bore stop, the drive wrench contacting the slanted face such that the drive wrench pushes the pin clear of the motion of the drive wrench until the drive wrench contacts the bore stop.

In another embodiment of the system the adapter connects to a Kelly bar of an auger. The adapter and the connector may also be co-formed as a single unit.

In a still further embodiment, there is described herein a method for installing an earth anchor, the method comprising: providing a drive wrench having a hole therein; providing a locking dog, the locking dog including: a main body connected to the connector, the main body including a polygonal shaped bore, the bore having a bore stop at its terminal end and having a plurality of inner surfaces; a locking pin mechanism, the locking pin mechanism including: a locking pin, the locking pin having a central axis and including a slanted face toward one end of the central axis; a support sleeve; and a biasing member for biasing the slanted face of the pin into the bore when the locking pin is positioned within the support sleeve; placing the drive wrench in the polygonal shaped bore; moving the drive wrench in the polygonal shaped bore toward the bore stop; contacting the slanted face of the pin with a portion of the drive wrench so that the portion of the drive wrench pushes the pin clear of the motion of the drive wrench; allowing the biasing member to bias the pin through the hole when the drive wrench contacts the bore stop, the pin then supporting the drive wrench; attaching an earth anchor to the drive wrench; and installing the earth anchor.

DETAILED DESCRIPTION OF THE PREFERRED EMBODIMENTS

Figure 1:
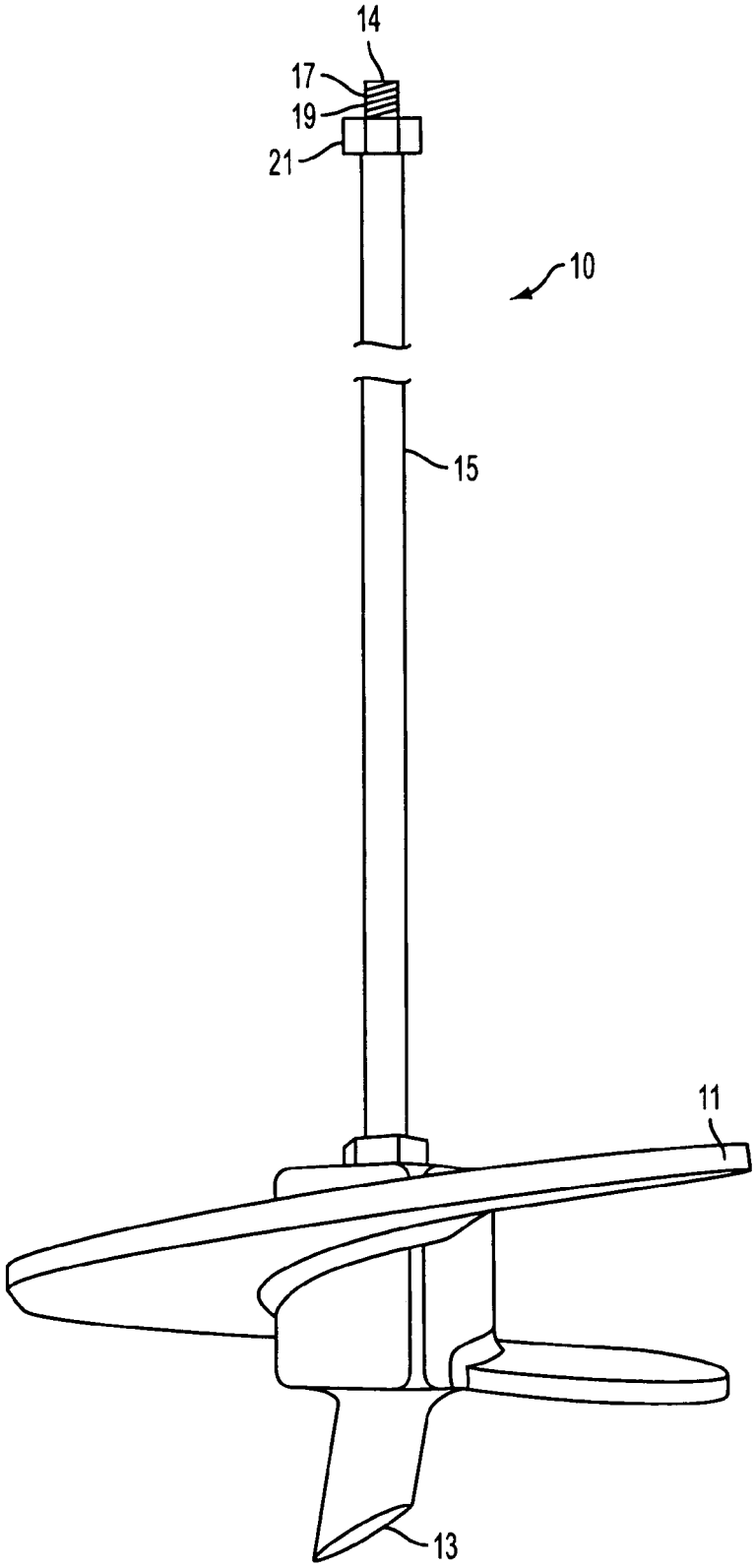
FIG. 1 PRIOR ART
FIG. 1 is a front view of a screw type anchor of the prior art.
Figure 2:
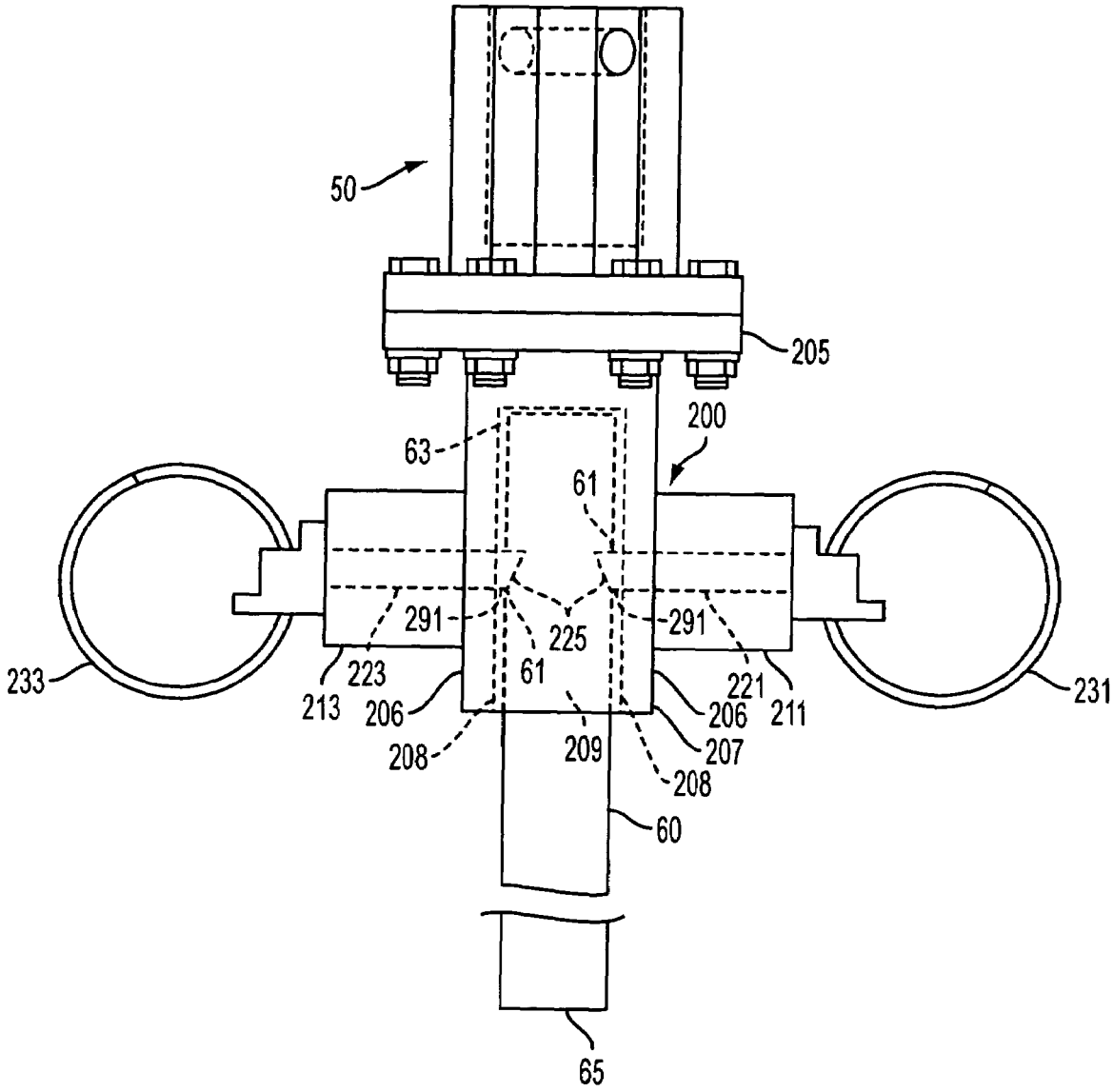
FIG. 2 PRIOR ART
FIG. 2 is a front view of a Kelly bar connector and locking dog assembly of the prior art.
Figure 4:
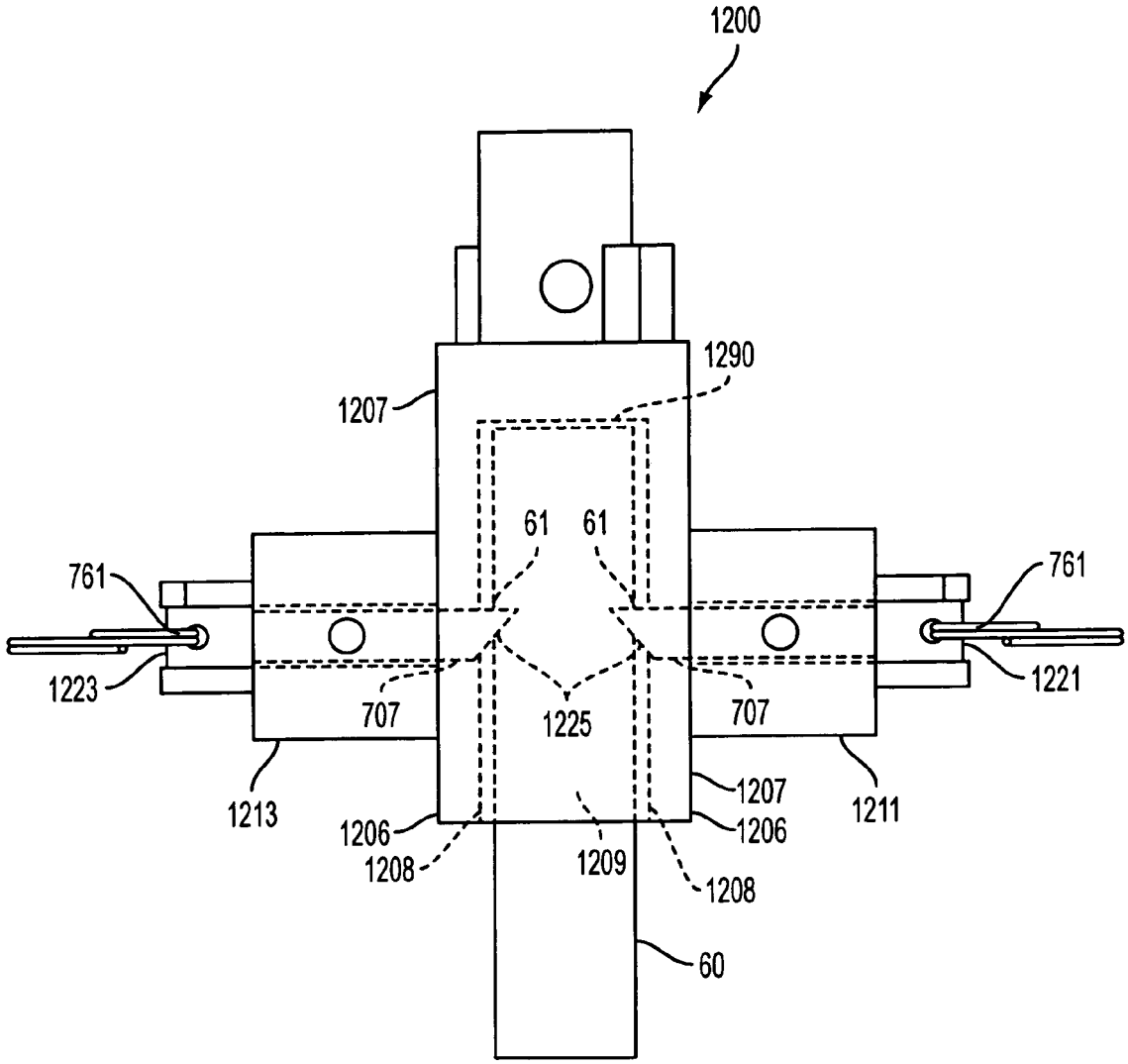
FIG. 4 shows a front view of a pilot hole locking dog utilizing the improved pin mechanism.
Figure 5:
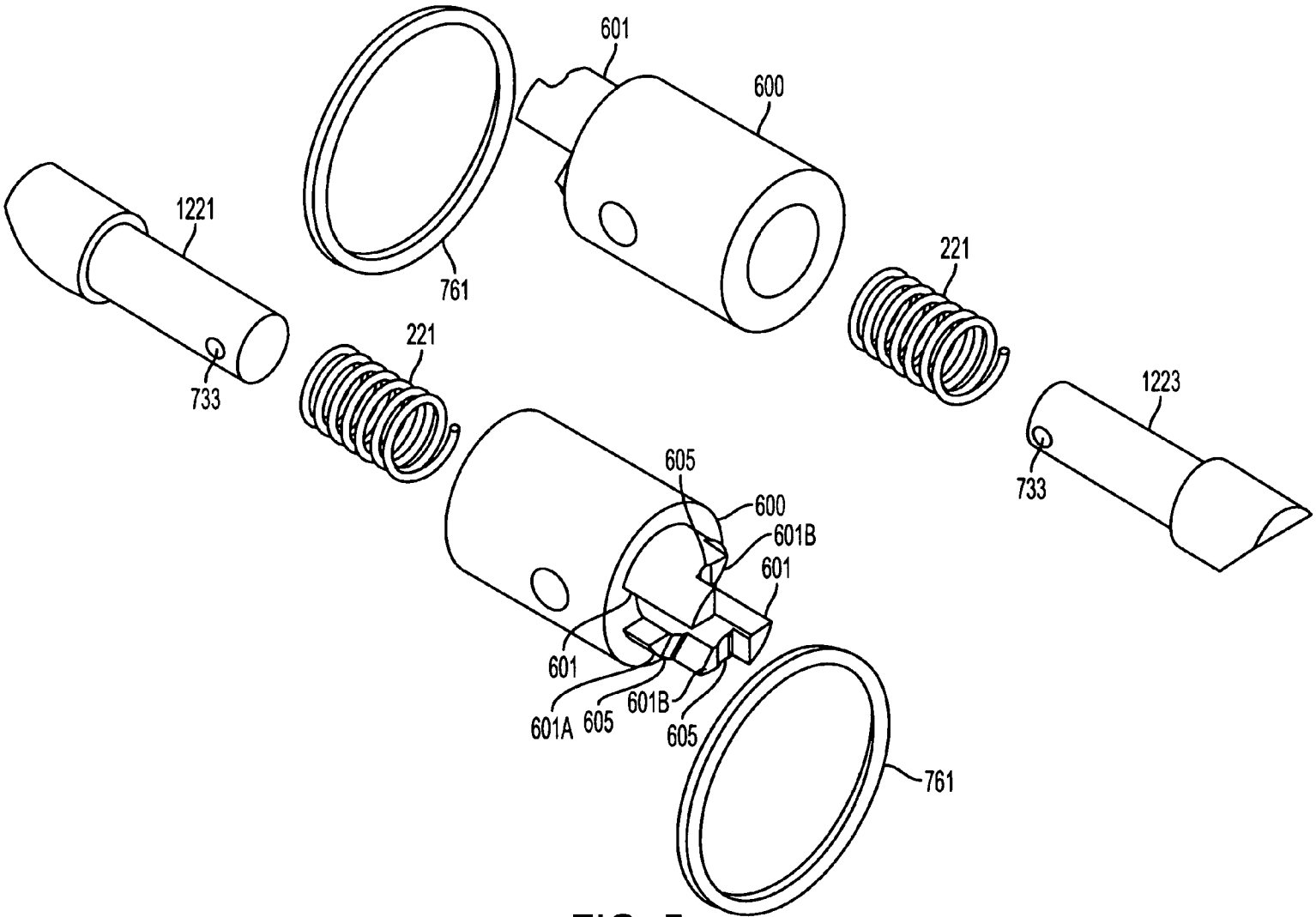
FIG. 5 shows an exploded view of the pin locking mechanisms from the device of FIG. 4.
Figure 6A:
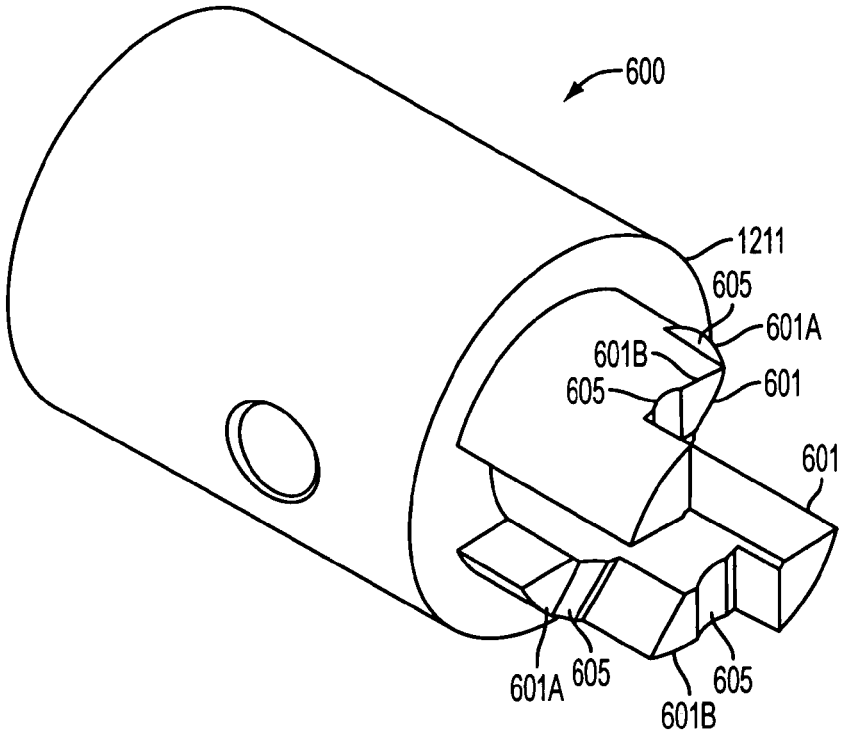
FIG. 6 shows various views of the pin mounting of FIG. 4.
Figure 6B:
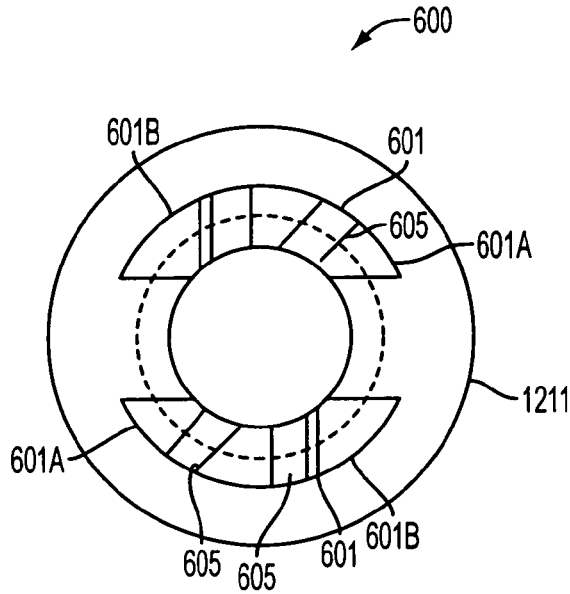
Figure 6C:
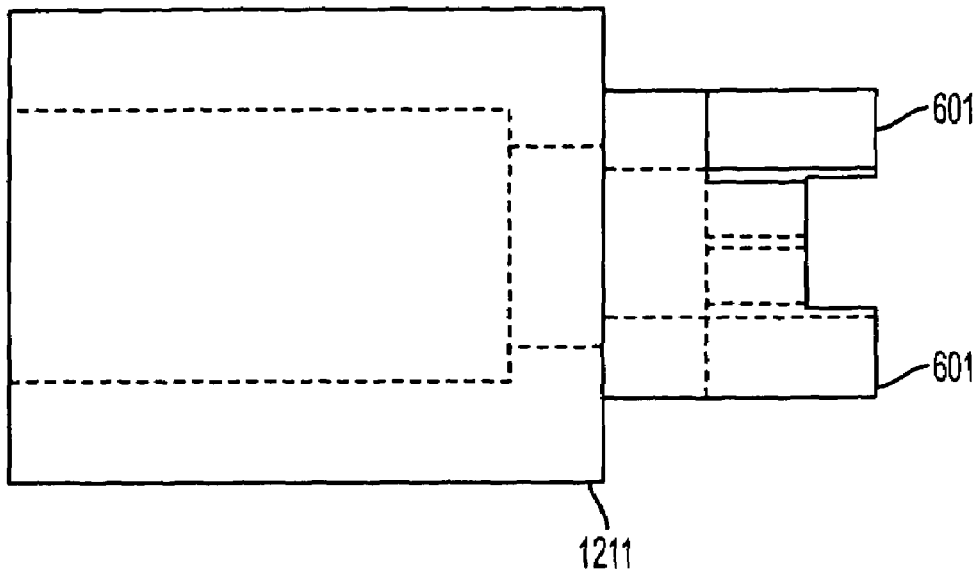
Figure 6D:
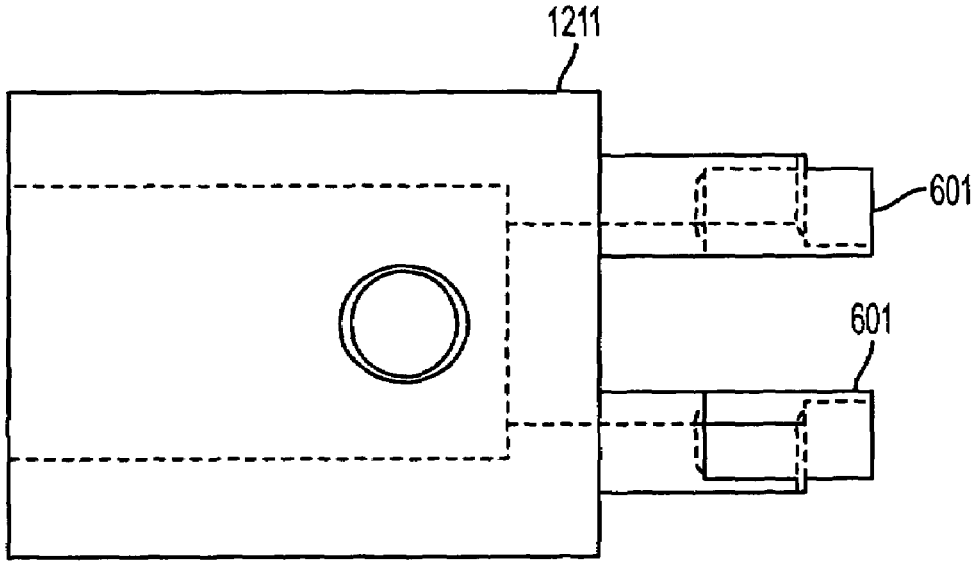
Figure 7A:
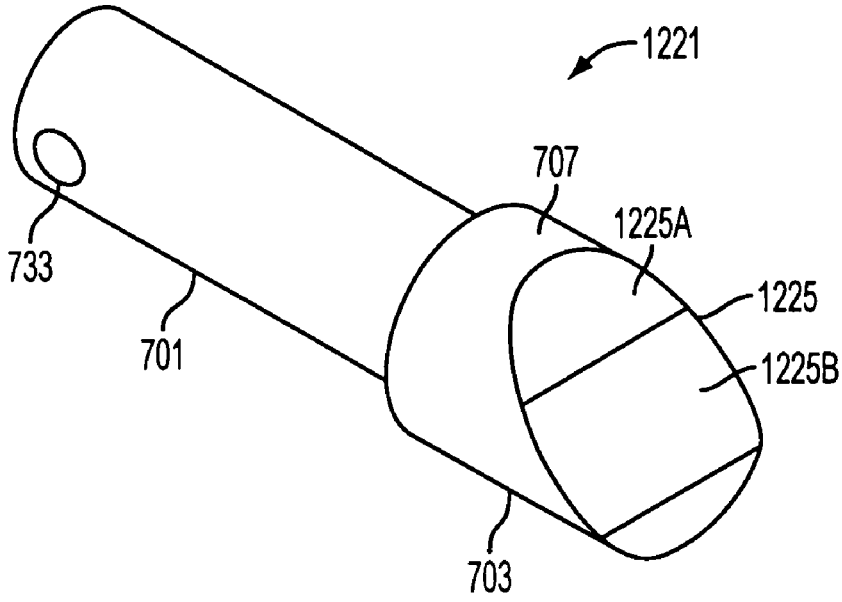
FIG. 7 shows various views of the locking pin of FIG. 4.
Figure 7B:
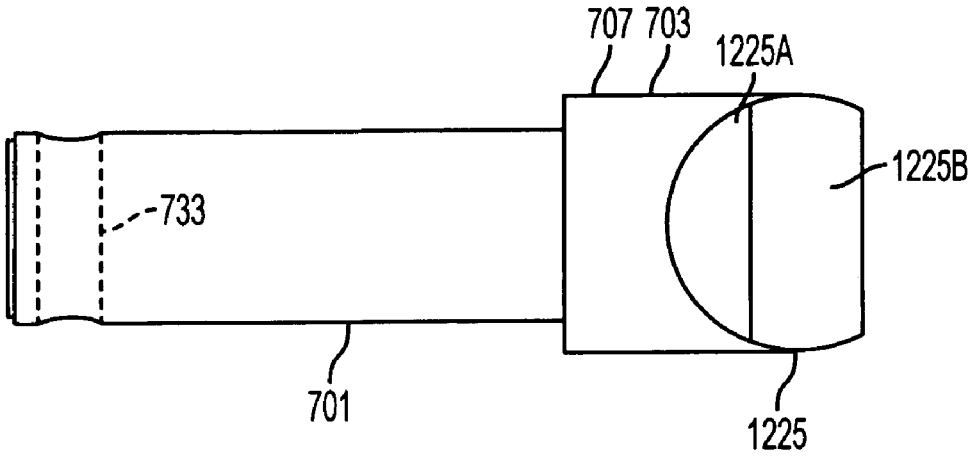
Figure 7C:
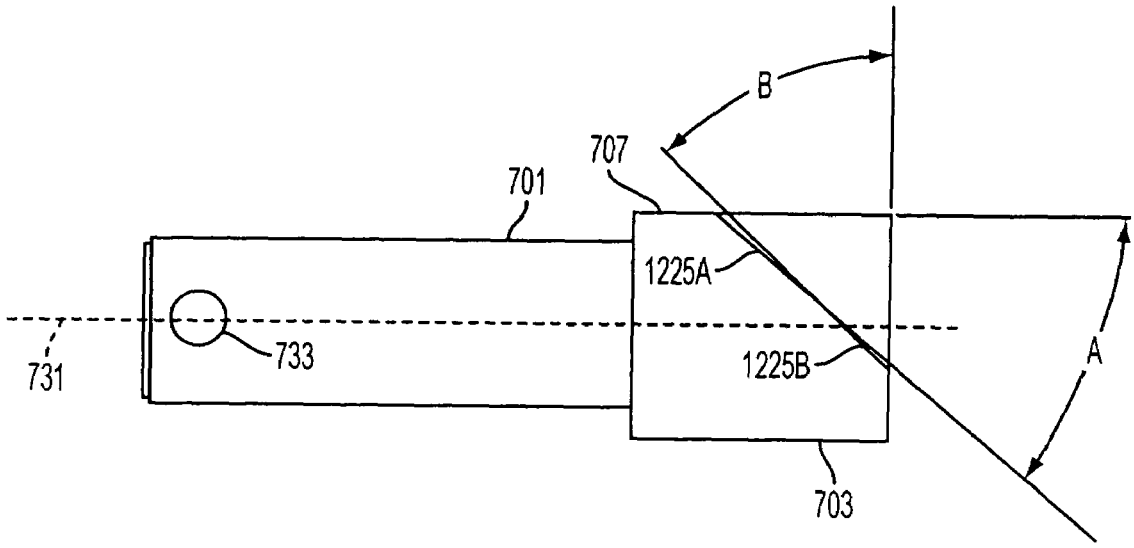
Figure 7D:
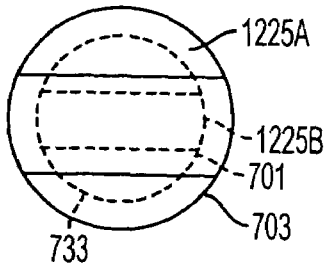

FIG. 4 provides a depiction of a pilot hole locking dog (1200) having a connecting shaft (811) sized and shaped to interface with the pilot bit hole (1203) of the auger (800). This is a locking dog assembly of the type described in U.S. patent application Ser. No. 10/892,972, the entire disclosure of which is herein incorporated by reference. While this pilot hole locking dog (1200) will be used as an exemplary embodiment of a locking dog to show how the pin locking mechanism (1210) of the present case may be used, this illustration is in no way intended to indicate that the pin locking mechanism (1210) discussed herein cannot be used on other types of locking dogs. In particular, the pin locking mechanism (1210) may be used on a traditional locking dog (200), such as that shown in FIG. 2 or may be used on other locking dogs known to those of ordinary skill in the art.

Regardless of the design used, the locking dog (1200) will generally include a sleeve (1207) having a generally polygonal bore (1209) therein. The sleeve (1207) will generally have a structure of relatively fixed and rigid width between the inner surface (1208) which defines the bore and an outer surface (1206) on the exterior of the locking dog (1200). Further, the locking dog (1200) will generally include at least two laterally extending sleeves (1211) and (1213) extending in generally perpendicular relation to the bore (1209) each of which includes a spring biased pin (1221) and (1223). The bore (1209) will be of a predetermined length terminating in a bore stop (1290) which may either be the top of the bore (1209) as shown in the depicted embodiment, or an object fixed inside the bore (1209) that is of sufficient shape and size to inhibit the drive wrench from passing the bore stop (1290).

Figure 3A:
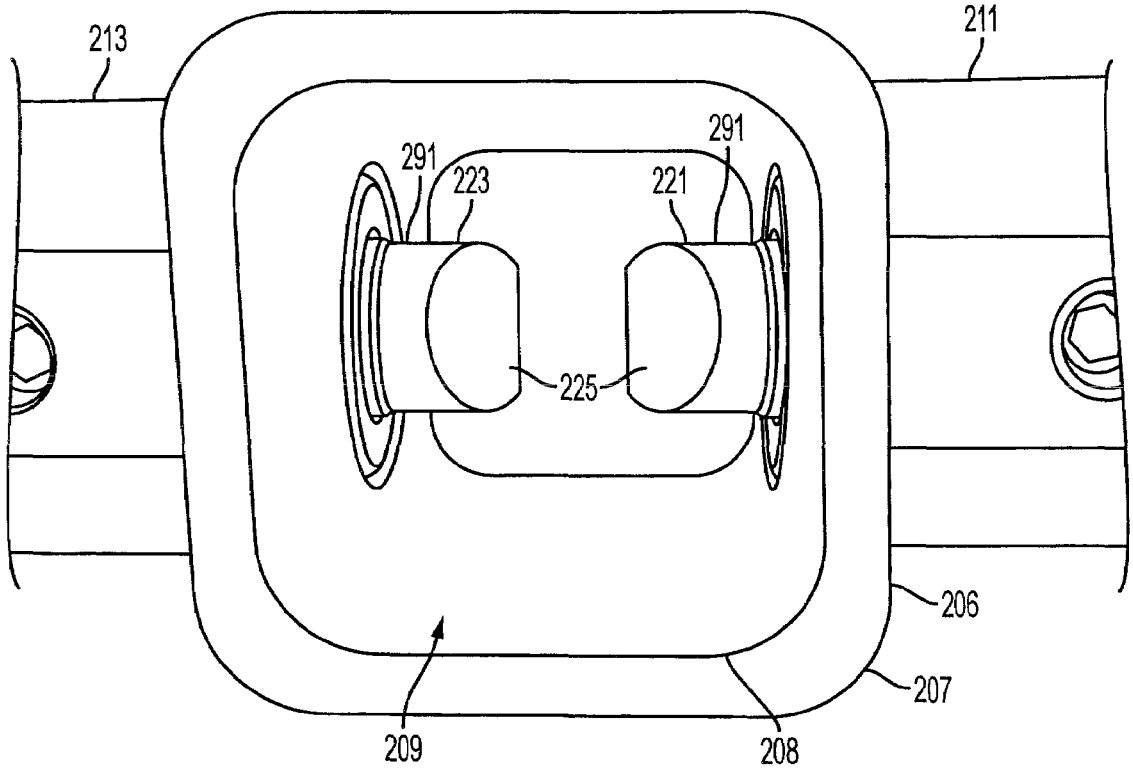
FIG. 3A PRIOR ART
FIG. 3 shows the pins of the assembly of FIG. 2 in the first (FIG. 3A), second (FIG. 3B), and third (FIG. 3C) positions.
Figure 3B:
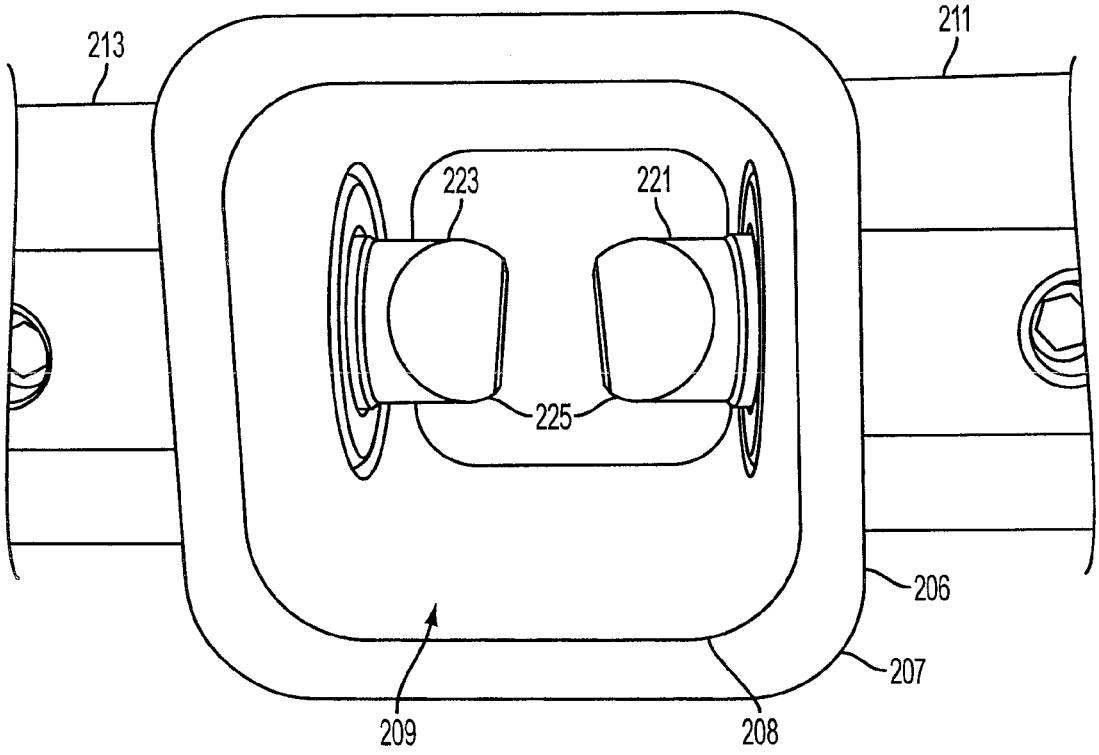
FIG. 3B PRIOR ART
Figure 3C:
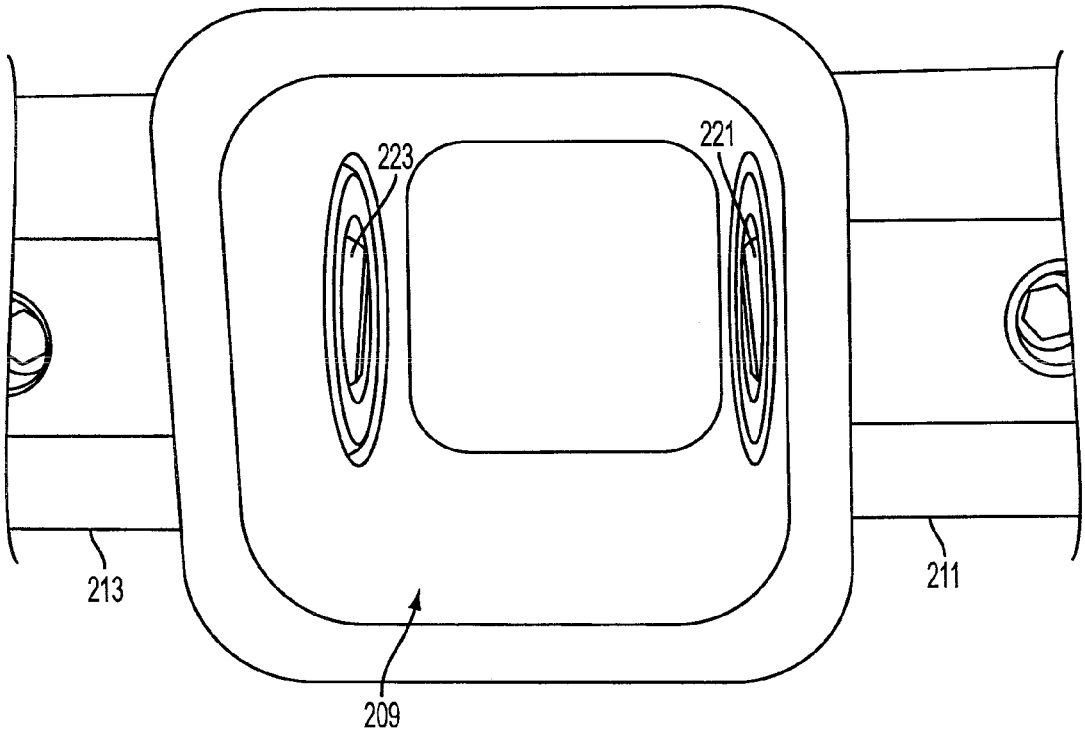
FIG. 3C PRIOR ART

As can be seen in FIG. 3, which is looking into the open end of the bore (809), in the prior art locking dog (200), the pins (221) and (223) must be completely retracted to their third position (FIG. 3C) to allow the drive wrench (60) to be placed into the hollow bore (209) in such a manner that the pins (221) and (223) can pass into the holes (61) in the drive wrench. In their first position (FIG. 3A), the ring (291) on each of the pins (221) and (223) extends into the bore (209). If the drive wrench (60) is pushed into the bore with the pins (221) and (223) in this first position, the top of the drive wrench (60) will impact the rings (291) which will inhibit movement of the drive wrench beyond the pins (221) and (223) and will not allow the drive wrench (60) to be secured. In the second position (FIG. 3B), the slanted faces (225) of the pins (221) and (223) are tilted to the side due to the rotary motion used to place the grasping mechanism on the support step to restrain the pins (221) and (223) in this position. In this arrangement, the top of the drive wrench (60) will once again impact the pins (221) and (223) and will not push them out of the way. In particular, the drive wrench (60) will hit the side of the pins (221) and (223) and stop. Further, once the drive wrench (60) is in place, the pins (221) and (223) must then be manually released to their first position to allow for the drive wrench (60) to be locked into place by having the pins (221) and (223) pass through the holes (61). This can be a difficult procedure and necessarily limits the maximum length of the drive wrench (60) as the worker needs to be able to reach the locking dog (200) with the drive wrench (60) in place.

Figure 8A:
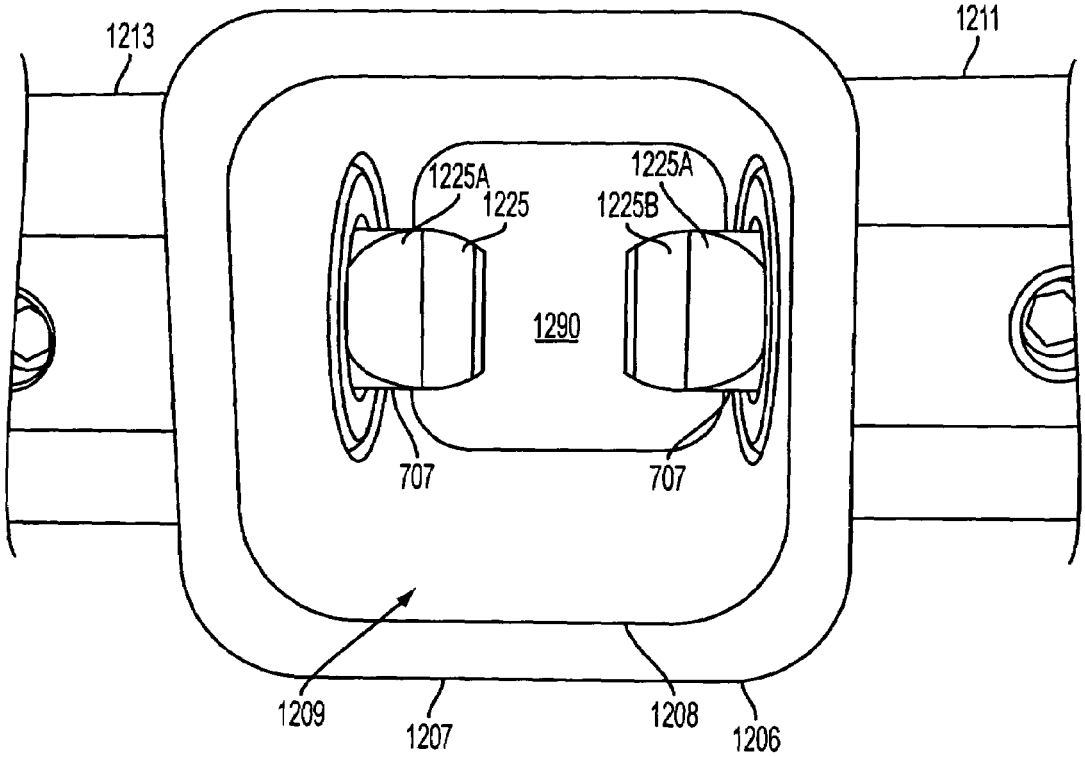
FIG. 8 shows the pins of the assembly of FIG. 4 in the first (FIG. 8A), second (FIG. 8B), and third (FIG. 8C) positions.
Figure 8B:
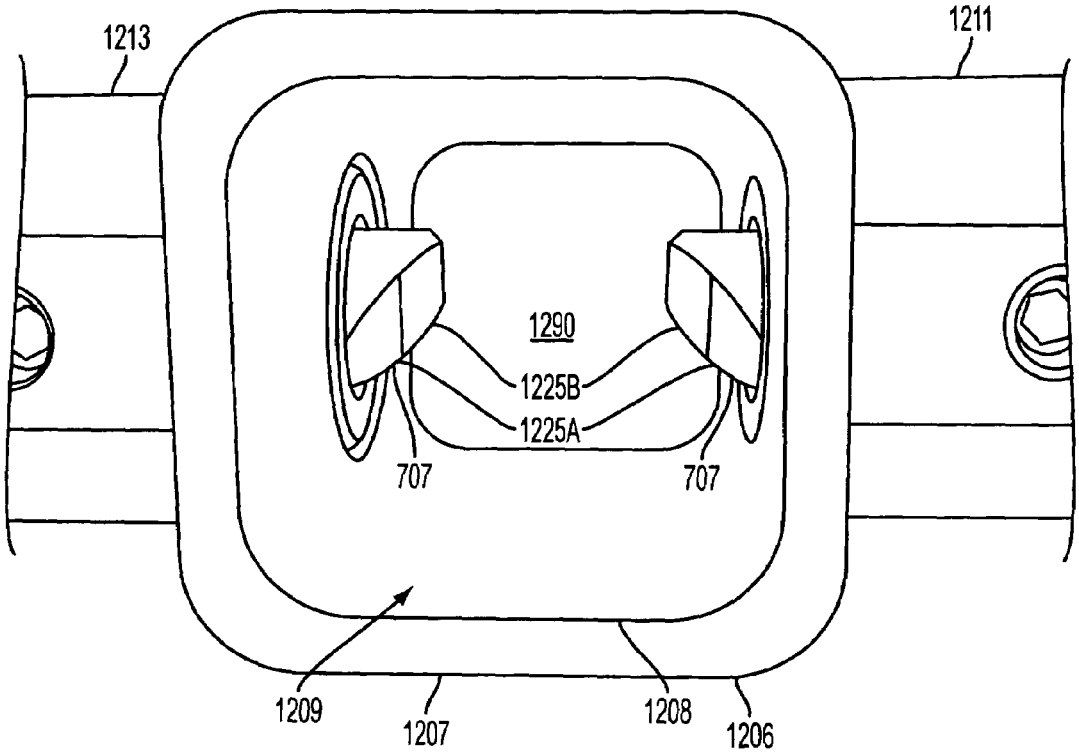
Figure 8C:
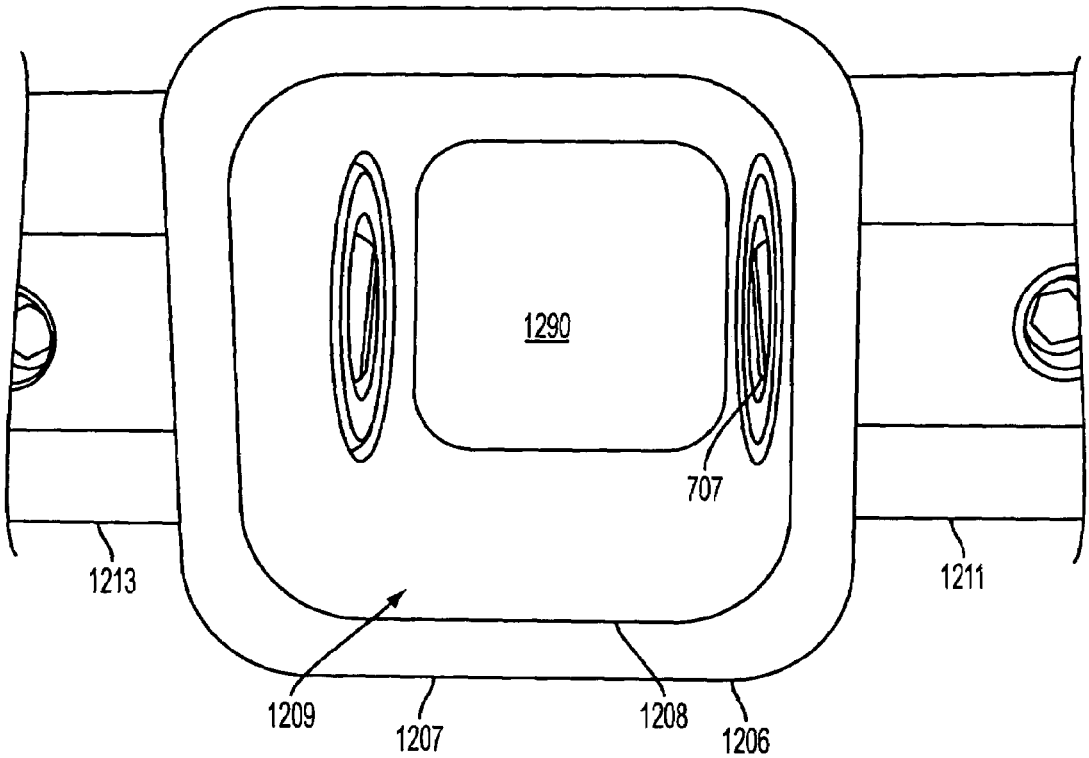

In the embodiment of FIGS. 4–8, pins (1221) and (1223) are used which allow the drive wrench (60) to be placed in the bore (1209) with the pins (1221) and (1223) still in their first position (FIG. 8A). In particular, the pins (1221) and (1223) do not include a ring (291) instead having a different slanted face (1225). This slanted face (1225) is particularly designed so as to effectively intersect with the internal surface (1208) of the sleeve (1207). In particular, the lowest point of the face (1225) (the point furthest from the bore stop (1290)) is preferably either flush with the internal surface (1208), or is positioned either within the width of the sleeve (1207) or outside the external surface (1206) so that the face (1225) is visible at all points inside the bore (1209).

In operation, a user can leave the pin (1221) and (1223) in the first position (FIG. 8A), during drive wrench (60) installation. As the drive wrench (60) is placed, the top of the drive wrench (60) will impact the slanted face (1225). The force of the drive wrench (60) being pushed toward the bore stop (1290), will be translated to force along a central axis of the pins (1221) and (1223) which will push the pins (1221) and (1223) outward against the biasing mechanism (1222). When the top of the drive wrench (60) is no longer in contact with the slanted face (1225), the drive wrench (60) has unobstructed motion toward the bore stop (1290). As the drive wrench (60) advances higher in the bore (1209), the holes (61) will eventually be aligned with the pins (1221) and (1223). At this time, the biasing member (1222) of each pin (1221) and (1223) will bias the pin (1221) or (1223) through the hole (61). The steps (601) (discussed later) do not inhibit pins (1221) and (1223) from moving as the pins (1221) and (1223) are not rotated during this type of installation, but are simply pushed against the biasing member (1222). In effect, the only prohibition on the pins (1221) and (1223) being in their first position (FIG. 8A) is that the movement is inhibited by a presence of a solid portion of the drive wrench (60). The pins (1221) and (1223) could again start to be pushed outward as the lower edge of the hole (61) begins to contact the slanted face (61) but generally before the pins (1221) and (1223) can clear the hole (61), the top of the drive wrench (60) will impact the bore stop (1290), halting upward motion. It is generally preferred that the bore stop (1290) be arranged relative to the pins (1221) and (1223) such that the top of the drive wrench (60) impacts the bore stop (1290) at relatively the same time that the pins (1221) and (1223) enter the holes (61). In this way, the pins (1221) and (1223) cannot be retracted any significant distance when within the holes (61). This prevents an upward force on the drive wrench (60), such as from the drilling action, to allow the pins (1221) and (1223) to push against the biasing members (1222) in such as way that they would release the guy rod (15) during drilling.

This arrangement allows the drive wrench (60) to be essentially press fitted into the bore (1209) without need of the operator to manually move the pins (1221) and (1223) to their third position to place the drive wrench (60), and manually move them back to their first position to lock the drive wrench (60) in place. This allows for any length of drive wrench (60) to be easily used which can enable deeper anchor installation to be performed much easier.

This type of arrangement also allows for the derrick to be used to install the drive wrench (60) with less human involvement. In particular, instead of the user having to place the pins (1221) and (1223) in their third position, install the drive wrench (60) and then release the pins (1221) and (1223) from their third position to their first, the derrick may push the locking dog assembly (1200) onto the drive wrench (60) with the pins (1221) and (1223) in the first position, and the drive wrench (60) braced against a solid object such as the ground. The derrick effectively does the work of installation saving labor and hassle for the user.

FIG. 7 provides a preferred design of a pin (1221) to allow this type of connection including a particular embodiment of a slanted face (1225). This FIG. shows various views of the pin (1221) separated from the rest of the pin locking mechanism (1210). Pin (1221) is essentially identical to pin (1223) so this discussion could be easily applied to pin (1223). The pin (1221) preferably includes two major portions, the pin shaft (701) and the pin head (703). The pin shaft (701) is of generally cylindrical construction to allow the pin to rotate within the circular bore of each of the appropriate laterally extending support sleeve (1211) or (1213) which form the body structure of the support mechanism (600). At the end of the pin shaft (701) there will generally be a throughbore (733) with same form of grasping mechanism (761) attached thereto. The pinhead (703) is located on one end of the pin shaft (701) and is also generally cylindrical and of a greater diameter than the pin shaft (701). The pin head (703) also includes a slanted face (1225) at the opposing end to the end connected to the pin shaft (701). The slanted face (1225) generally results from the cylinder forming the pin head (703) being cut through at an angle not perpendicular to the major axis (731) of the pin (1221) in such as fashion that preferably a portion of the end remains as does a position of the pin head (703) down the axis. This also effectively results in the slanted face being at an angle with the axis of the pin shaft (701) and the axis of the pin (2221) as a whole. In the depicted embodiment, the slanted face (1225) actually has two sections and does not comprise a single angle. In effect, in this embodiment, the slanted face (1225) is not a planar surface but is "bent."

The two portions of the slanted face (1225) are designated the lower face (1225A) and the upper face (1225B). The lower face (1225A) will generally form an angle A with the center axis of the pin (1221). The angle A may be any angle between 0 and 90 degrees exclusive and is preferably between about 35 and about 45 degrees, more preferably being about 40 degrees. The upper face (1225B) will generally form an angle B with the axis of the pin (1221). The angle B can be any angle between 0 and 90 degrees exclusive and is preferably between about 35 and about 50 degrees, more preferably being about 45 degrees.

This means that the pin head (703) generally has an increased surface area comprising the slanted face (1225) than would be the case if both the portions of the slanted face (1225) were at the same angle. However, in an alternative embodiment, the slanted face (1225) may be planar. The dual face provides a larger surface area which may be contacted by the top of the drive wrench. Further, the dual face provides for a slight alteration of force as the biasing member (1222) is compressed by the pin (1221), which may be considered beneficial in some embodiments. Generally, the biasing member (1222) will be a spring and as is well known to those of ordinary skill in the art, the restoring force generated by a spring is proportional to its distance of deformation. By using the double face, a smaller percentage of the force being applied to move to drive wrench upward is transferred to the spring at the start, when the restoring force is less, while at the second section, more force from the upward movement is applied to the spring when the restoring force is greater.

The slanted face (1225) intersects the pin head (703) outer surface at a position spaced from the base of the pin head (703). This distance is specifically chosen to provide that the circular ring section (707) where the pin head (703) is not contacted by the slanted face (1225), is small enough such that the circular ring section (707) does not extend into the bore (1209) through the plane of the inner surface (1208) when the pin (1221) is in the first position (FIG. 8A). While this width will generally be determined by the size and design of the locking dog (1200) as well as the arrangement of the pins (1221) and (1223) and biasing members (1222), in most cases a width of about 0.35 inches or less was found to be acceptable.

The pins (1221) and (1223), when placed in the locking dog (1200) and in the first position, are arranged, as can be seen in FIG. 8A such that the slanted face (1225) is the only surface of the pin head arranged toward the bore opening and visible when locking thereinto. The circular ring section (707) is maintained within or behind the sleeve (1207) of the locking dog (1200). In this arrangement, the drive wrench (60), when installed, can be placed by having the locking pin, (1221) and (1223) in the first position. The drive wrench is pushed into the bore (1209) (into the page of FIG. 8A). As the top of the drive wrench (60) reaches the pins (1221) and (1223), the top of the drive wrench (60) will impact the lower face (1225A) of the pin face (1225), the angle will cause the force from movement of the drive wrench (60) to be translated to generally linear movement of the pins (1221) and (1223) in a direction generally parallel with the page of FIG. 8A and against the biasing means. The drive wrench (60) will continue to slide along the face (1225) eventually passing to the upper face (1225B). Eventually, the drive wrench (60) will pass over the end of the slanted face (1225). At this time, the end of the pin head (703) will be pushed by the biasing mechanism (1222) against the side of the drive wrench (60), which should be able to slide relatively freely therepast. Once the drive wrench (60) has been sufficiently placed, the hole (61) in the drive wrench (60) will generally align with the pin head (703) (which is of generally similar size to the hole (61)) and the pin head (703) will be biased back into the bore (1209) and through the hole (61). The pin (1221) and (1223) in hole (61) arrangement will prevent the drive wrench (60) from moving in any direction except the prior upward direction because the outer rim of the hole (61) will not be able to slide past the pin head (703) as the slanted face (1225) is arranged at an angle relative to that direction. Preferably, at this time, the top of the drive wrench (60) will be pushed against the bore stop (1290), which will prevent upward movement of the drive wrench (60) and holding of the drive wrench (60) within the bore (1209).

The slanted face (1225) design allows for the drive wrench (60) to therefore be installed without having to manually move the pins (1221) and (1223) from the first position to the third position and then release the pins (1221) and (1223) once the drive wrench (60) is installed. In this arrangement, the pins (1221) and (1223) are simply depressed by the action of placing the drive wrench (60) which means that the operator does not need to be able to reach the locking mechanism which makes longer drive wrenchs (60) useable.

The locking pins (1221) and (1223) operate in generally the same fashion as the prior art pins (1221) and (1223) when moved to the second or third position. In the second position, the pins are retracted from the guy rod (15) and release the guy rod (15) to allow separation of the guy rod (15) from the locking dog (1200) without release of the drive wrench (60) (which is still held by the portion of the pin head (703) which extends into the bore (1209)). In the third position, the pins release the drive wrench (60) to allow for its removal.

A locking dog (1200) including pins (1221) and (1223) is particularly useful for installation of deep anchors with long guy rods (15). The length of the useable guy rod (15) for any anchor is limited by the length of the useable drive wrench (60) for installing it. In prior designs, the length of the drive wrench (60) was limited based on the need for the user to be able to reach the grasping mechanism (761) and move the pins (1221) and (1223) from their third to first position while the drive wrench (60) is held in place in the locking dog. In the prior art, the drive wrench (60) would need to be laid out horizontally for lengths longer than an average user can reach vertically to carry out this installation. The problem with this, is that conventional locking dogs and other auger assemblies, do not necessarily have the ability to rotate to the horizontal relative to the derrick. Therefore, the length of drive wrenchs (60) tended to be limited. With this design, a drive wrench (60) of a much longer length can be easily used as the derrick and locking dog (1200) can be lowered onto the drive wrench (60) at a height much above the reach of a human user, as the drive wrench (60) is automatically latched by the pins (1221) and (1223) when in place. The user does not need to reach to the locking dog (1200) when installing the drive wrench (60) or the guy rod (15). When it is time to disconnect the guy rod (15) and drive wrench (60) (move from first to second position), the locking dog (1200) will generally be easily within reach, because the anchor will have been placed in a hole down which the guy rod (15) and drive wrench (60) extend. Further, once the locking dog has been moved a couple of feet, the shoulder (21) will have generally cleared the pins (1221) and (1223), allowing them to be easily in reach to move them from their second to their first position before fully removing the drive wrench (60) from the hole.

The locking mechanism (600) of FIG. 4 also provides for an additional element which makes the locking mechanism (600) easier to use. In particular, each of the support sleeves (1211) and (1213) generally uses a stepped support surface (601) as can be best seen in FIGS. 4 and 5 to hold the pins at their second or third positions. The stepped support surface (601) provides that to hold the locking pin (1221) or (1223) in either the second or third position, the pin (1221) or (1223) can be pulled against the biasing mechanism (122) by grasping the grasping member (761) and pulling on the grasping member (761) until it is beyond the height of the appropriate step (601A) or (601B). The grasping member (761) can then be rotated, which causes the pin shaft (701) to rotate within the sleeve (1211) or (1213) until the grasping member (761) reaches a particular point over the appropriate step (601A) or (601B). The grasping member (761) is then released and the pin (1221) or (1223) is biased back into the bore (1209) until the grasping member (761) contacts the step (601A) or (601B). When this occurs, the returning force of the biasing member (1222) is resisted by the contact between the grasping member (761) and the step (601A) or (601B) which keeps the pin (1221) or (1223) from being able to return to its first position.

While the restraining action of the steps (601A) and (601B) work quite well, generally a user of the locking dog (1200) will have gloves on when performing the movement of the pin (1221) or (1223) and the rotation of the grasping member (761) (and therefore the pin (1221) or (1223)), this can make it difficult for the user to see exactly where the grasping member (761) is rotated to relative to the stepped support surface (601). This can then result in the user placing the grasping member (761) in a position where the pin (1221) or (1223) is held in the second or third position, but it is unstable, such as right on the edge of a step (601A) or (601B), because it is difficult to see the stepped support surface (601) and because gloves tend to require more gross movements and may result in unintended movement of the pin (1221) or (1223) during placement. If the grasping member (761) is not solidly on a step (601A) or (601B), when force is applied to the locking dog (1200), such as during lifting of the drive wrench (60) from the guy rod (15), the grasping mechanism (761) and pin (1221) or (1223) in the locking dog (1200) can suddenly shift to a different position which can be problematic as it may suddenly cause reengagement of the locking dog (1200) to the guy rod (15) and pull on the anchor (10) which may potentially cause damage or an unexpected shift and potential injury.

To help the user find the appropriate locking point, there is included in each of the retaining steps (601A) and (601B) in the embodiment of the sleeve (1211) shown in FIG. 6 an indention (605) which generally corresponds to the outside shape of the grasping member (761) where the grasping member (761) will contact it. This indention (605) therefore provides for a place where the grasping member (761) will naturally gravitate (under the force of the biasing member (1222) or the pin (1221) or (1223)), when in the appropriate restrained position over the desired step (601A) or (601B), this embodiment will provide for a hold point of the grasping member (761) closer to the equilibrium point of the biasing member (1222) than at any other point on the step (601A) or (601B). Further, to move from the indentation (605), force would need to be applied to the biasing member (1222) against the returning force to lift the grasping member (761) from the indentation (605). This makes it harder for the grasping member (761) to slip from the step (601A) or (601B) as an additional force would be required in a direction different from that applied by the restoring force of the biasing member (1222). This indention (607) therefore provides for an improved contact between the grasping member (761) and the stepped support surface (601) making it easier for a user to insure the pin (1221) or (1223) is retained in a retracted position, even while wearing gloves.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A locking dog comprising.

a main body including a polygonal shaped bore, said bore having a bore stop at its terminal end and having a plurality of inner surfaces;

a locking pin mechanism, the locking pin mechanism including:

a locking pin, said locking pin having a central axis and including a slanted face toward one end of said central axis and having a grasping member toward the opposing end of said central axis, said slanted face being non-perpendicular to said central axis;

a support sleeve including a retaining step; and a biasing member for biasing said slanted face of said pin into said bore when said locking pin is positioned within said support sleeve;

wherein, when said biasing member is in a first position where said grasping member is not interacting with said retaining step, the plane defined by at least one of said inner surfaces of said bore intersects with said slanted face.

2. The locking dog of claim 1 wherein said locking pin can be retracted from said bore and said grasping member can be rotated to a second position such that said grasping member is in contact with said retaining step; said grasping member's contact with said retaining step preventing said biasing member from restoring said pin to said first position.

3. The locking dog of claim 2 wherein said support sleeve includes a second retaining step.

4. The locking dog of claim 3 wherein said locking pin can be retracted from said bore and said grasping member can be rotated to a third position such that said grasping member is in contact with said second retaining step; said grasping member's contact with said second retaining step preventing said biasing member flom restoring said pin to said first position or said second position.

5. The locking dog of claim 4 wherein said one of said retaining step and said second retaining step includes an indentation, said indentation being designed to resist movement of said grasping member from said retaining step.

6. The locking dog of claim 2 wherein said retaining step includes an indentation; said indentation being designed to resist movement of said grasping member from said retaining step.

7. The locking dog of claim 1 wherein said slanted face comprises two portions, each of said sections being arranged at a different angle relative to said central axis of said locking pin.

8. The locking dog of claim 7 wherein said angles comprise about 40 degrees and about 45 degrees.

9. The locking dog of claim 1 wherein said slanted face forms an angle of between about 40 and about 50 degrees, with said central axis.

10. The locking dog of claim 4 wherein:

when said pin is in said third position, no portion of said pin is within said bore;

when said pin is in said second position, a first portion of said pin is within said bore; and when said pin is in said first position, a second portion, greater than said first portion is within said bore.

11. The locking dog of claim 1 wherein said locking pin comprises:

a pin head having a cylindrical structure with two ends and a length therebetween, said slanted face intersecting one of said ends and said length and being non-perpendicular to a central axis of said cylindrical structure so that a portion of said end remains;

a cylindrical pin shaft attached to said pin head in such fashion that a central axis of said cylindrical pin shaft is co-linear with said central axis of said cylindrical structure of said pin head, said co-linear central axes defining said central axis of said locking pin.

12. The locking dog of claim 11 wherein the plane of said portion of said end is generally perpendicular to said central axis of said locking pin.

13. The locking dog of claim 11 wherein said slanted face comprises two portions, each of said sections being arranged at a different angle relative to said central axis of said locking pin.

14. The locking dog of claim 13 wherein said angles comprise about 40 degrees and about 45 degrees.

15. A system for installing earth anchors, the system comprising:

a derrick, having an adapter for attachment to a locking dog;

a drive wrench;

a locking dog, said locking dog including:

a connector for attaching said locking dog to said adapter;

a main body connected to said connector, said main body including a polygonal shaped bore, said bore having a bore stop at its terminal end and having a plurality of inner surfaces;

a locking pin mechanism, the locking pin mechanism including:

a locking pin, said locking pin having a central axis and including a slanted face toward one end of said central axis and having a grasping member toward the opposing end of said central axis, said slanted face being non-perpendicular to said central axis;

a support sleeve including a retaining step; and a biasing member for biasing said slanted face of said pin into said bore when said locking pin is positioned within said support sleeve;

wherein, when said biasing member is in a first position where said grasping member is not interacting with said retaining step, the plane defined by at least one of said inner surfaces of said bore intersects with said slanted face, and wherein, said drive wrench can be placed in said polygonal shaped bore and moved toward said bore stop, said drive wrench contacting said slanted face such that said drive wrench pushes said pin clear of the motion of said drive wrench until said drive wrench contacts said bore stop.

16. The system of claim 15 wherein said adapter connects to a Kelly bar.

17. The system of claim 15 wherein said adapter connects to an auger.

18. The system of claim 15 wherein said adapter and said connector are co-formed.

19. A method for installing an earth anchor, the method comprising:

providing a drive wrench having a hole therein;

providing a locking dog, said locking dog including:

a connector for attaching said locking dog to a denick:

a main body connected to said connector, said main body including a polygonal shaped bore, said bore having a bore stop at its terminal end and having a plurality of inner surfaces;

a locking pin mechanism, the locking pin mechanism including:

a locking pin, said locking pin having a central axis and including a slanted face toward one end of said central axis and having a grasping member toward the opposing end of said central axis, said slanted face being non-perpendicular to said central axis;

a support sleeve including a retaining step; and a biasing member for biasing said slanted face of said pin into said bore when said locking pin is positioned within said support sleeve;

placing said locking pin in a first position where said grasping member is not interacting with said retaining step and the plane defined by at least one of said inner surfaces of said bore intersects with said slanted face;

placing said drive wrench in said polygonal shaped bore;

moving said drive wrench in said polygonal shaped bore toward said bore stop;

contacting said slanted face of said pin with a portion of said drive wrench so that said portion of said drive wrench pushes said pin clear of the motion of said drive wrench;

allowing said biasing member to bias said pin through said hole when said drive wrench contacts said bore stop, said pin then supporting said drive wrench;

attaching an earth anchor to said drive wrench; and installing said earth anchor.

* * * * *